United States Patent [19]

Nicholson

[11] 3,990,637

[45] Nov. 9, 1976

[54] SHOWER FOR FABRIC CONDITIONING

[75] Inventor: Charles B. Nicholson, Glen Falls, N.Y.

[73] Assignee: Albany International Corporation, Albany, N.Y.

[22] Filed: Jan. 27, 1976

[21] Appl. No.: 652,717

[52] U.S. Cl. ..... 239/108; 239/456

[51] Int. Cl.[2] ..... B05B 15/02

[58] Field of Search ..... 239/109, 106, 108, 107, 239/452, 456

[56] References Cited

UNITED STATES PATENTS

| | | | |
|---|---|---|---|
| 1,057,780 | 4/1913 | Sheldon | 239/452 X |
| 1,143,293 | 6/1915 | Luehrs | 239/108 |
| 1,826,977 | 10/1931 | Baker | 239/109 |
| 2,129,145 | 9/1938 | Lincoln | 239/452 X |
| 2,803,499 | 8/1957 | Goyette et al. | 239/109 |

*Primary Examiner*—John J. Love

*Attorney, Agent, or Firm*—Kane, Dalsimer, Kane, Sullivan and Kurucz

[57] ABSTRACT

A shower for use in fabric conditioning in paper making utilizing a two position nozzle. One position being a spray position and in which the nozzle is maintained in this position by normal liquid pressure in the spray pipe and a second position which is a purging position and in which the nozzle is maintained in this position by application of air pressure.

5 Claims, 5 Drawing Figures

SHOWER FOR FABRIC CONDITIONING

BACKGROUND OF THE INVENTION

Showers are used in the paper making industry to condition fabrics. One such fabric conditioning application is where a flood of water or other liquid under low pressure is supplied to the felt surface to flush dirt particles from the felt and to neutralize wet streaks. A second conditioning application is where water is sprayed under pressure onto a felt in order to actually dislodge dirt particles from the fiber/yarn structure and to resist compaction. This requires intermittent use.

Shower systems are provided today which combine both purging and spraying and nozzles are available such as that disclosed in U.S. Pat. No. 2,803,499 and U.S. Pat. No. 2,954,170 which perform this dual function. In nozzles of this type two positions of operation are utilized. One position being a purging position and one position being a spray position. The difficulty heretofore in the use of such systems has been the inability to transform without change of spray pipe water pressure, rapidly from one position to the other and the difficulty in making such transformation.

SUMMARY OF THE INVENTION

A spray pipe with a unique spray nozzle, said spray nozzle comprising a generally tubular body in alignment with the spray hole through the wall of the pipe, a bore of the tubular body, a piston slidably fitted in the tubular body within the bore, a central passage formed in the piston and communicating the interior of the spray pipe to the outside thereof, a first seal means mounted on the piston and cooperating with the tubular body to confine the contents of the spray pipe to the central passage, a valving member spaced from the tubular body and disposed on the center line of the central passage, a spray position of the piston with the outer end thereof abutting the valving member, the piston being maintained in the spray position by the force of the content of the spray pipe pressing thereagainst, a blocking surface of the valving member overlying a first portion of the central passage and blocking a portion thereof in the spray position, a spray surface of the valving member spaced from and overlying a second portion of the central passage in the spray position whereby liquid exiting the central passage in the spray position will impinge thereon to be formed into and directed as a spray, a radial flange of said piston within said bore, second seal means mounted on said flange and cooperating with said tubular body, third seal means mounted on said tubular body and cooperating with said piston, a pressure chamber within said bore provided by said second and third seal means, air pressure supply means, control means for introducing air pressure from said air pressure supply means within said pressure chamber to overcome the force of the content of the spray pipe and move the piston into the purging position, stop means formed on said body and against which said flange abuts in the purging position, and air evacuation means to evacuate air from the bore upon movement of the piston to prevent locking thereof.

DESCRIPTION OF THE PREFERRED EMBODIMENT

Figure 5:
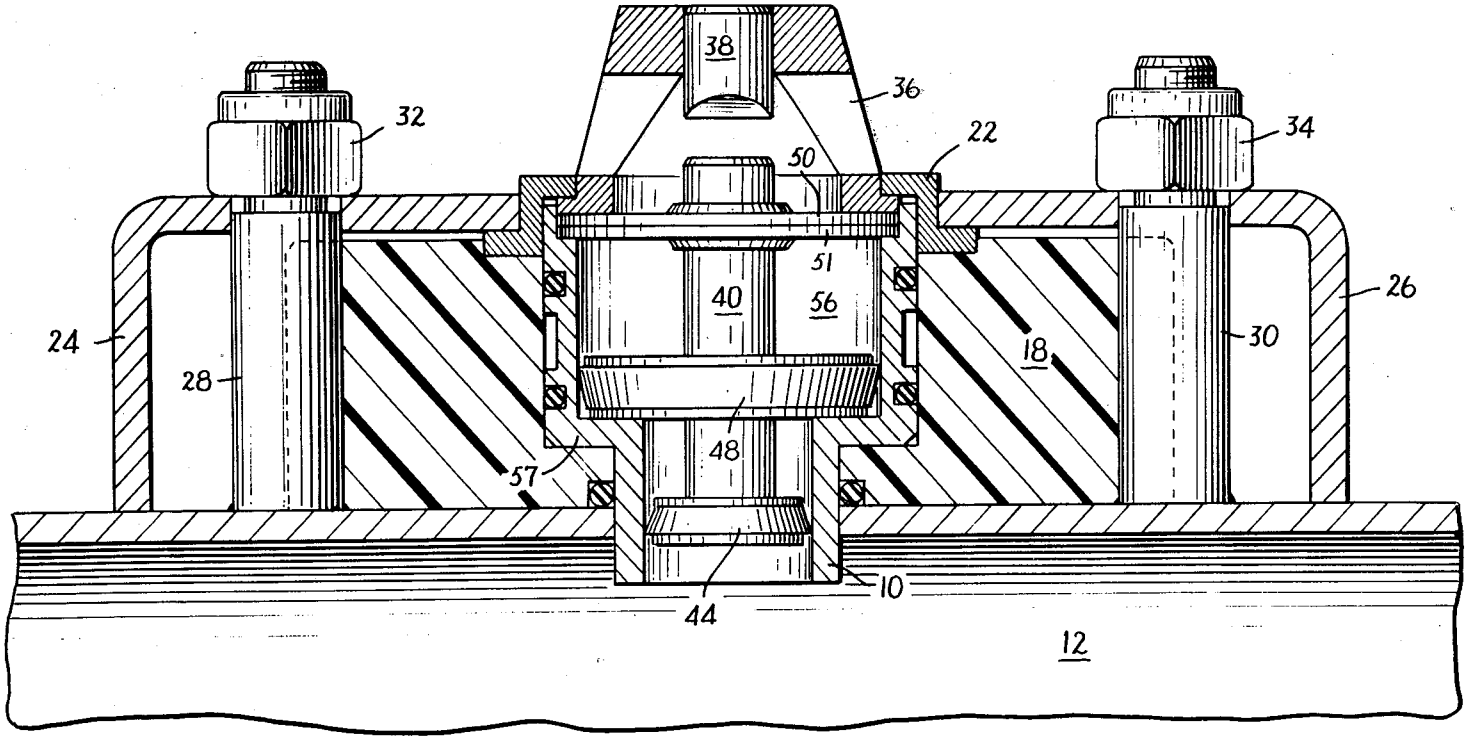
FIG. 5 is a longitudinal sectional view taken along the line 5—5 in the direction of the arrows in FIG. 1.

In the Figs. the generally tubular body member or casing 10 which is preferably formed of a metal such as stainless steel is in alignment with and projecting through the spray hole 11 in the wall of spray pipe 12. The member 10 which has a small diameter cylindrical section 14 and a cylindrical section 16 of greater diameter is surrounded by plastic 18 and maintained in fixed position with respect to spray pipe 12 by collar 22 and brackets 24 and 26 as seen in FIG. 5 which are mounted on the spray pipe by posts 28 and 30 which are welded to the spray pipe and nuts 32 and 34.

A further bracket 36 projects upwardly and supports valving member 38 in position and for a purpose as will be explained below.

Piston 40 is slidably fitted within the bore of casing 10. The piston has a central passage 42 formed therein which communicates the interior of the spray pipe to the outside thereof.

Elastomeric lip seal 44 is supported on the piston at the lower end thereof by seal support flange members 45 and 47 and provides a first seal means which cooperates with the tubular body 10 to seal the bore of body 10 and prevent the contents of the spray pipe from entering the casing bore and to confine the same to the central passage 42.

Radial flanges 46 and 49 provide a flange seal support on the piston 40 within the casing bore to support lip seal 48 which provides a second seal means cooperating with the tubular body 10. A third seal means is provided by nylon discs 50 and 51 which are in facing relating and mounted on the body 10 by sandwiching of its peripheral edge between the shoulder 52 of casing 10 and annular base 54 of valving member 38. The members 50 and 51 cooperate with piston 40 which is slidably moveable within annular slot 55 formed therein to provide a third seal means. The second and third seal means provide a pressure chamber 56 within the casing bore.

As mentioned above, the bracket 36 which projects upwardly from ring 54 and which forms a hood therewith supports valving member 38. The valving member 38 has a generally cylindrical body whose centerline is an extension of the centerline of central passage 42. A convex slice has been removed therefrom as shown in the figures providing a slightly concave spray surface 39. Surface 39 is an impinging surface for the water and determines the spray configuration. Accordingly the particular configuration of surface 39' shown herein is by way of example only and other shapes may be formed as desired. Surface 41 which lies in a plane perpendicular to the centerline of passage 42 provides a blocking surface which prevents outward flow over more than half the central passage 42 cross section. In the position of the piston shown in FIG. 3 for example, the spray position, the outer end of the piston abuts surface 41 which overlies a portion of the central passage 42 and blocks a portion thereof. The spray surface 39 is spaced from and overlying a second portion of the central passage and liquid exiting the central passage from spray pipe 12 will impinge on surface 39 to be formed into and directed as a spray.

Figure 3:
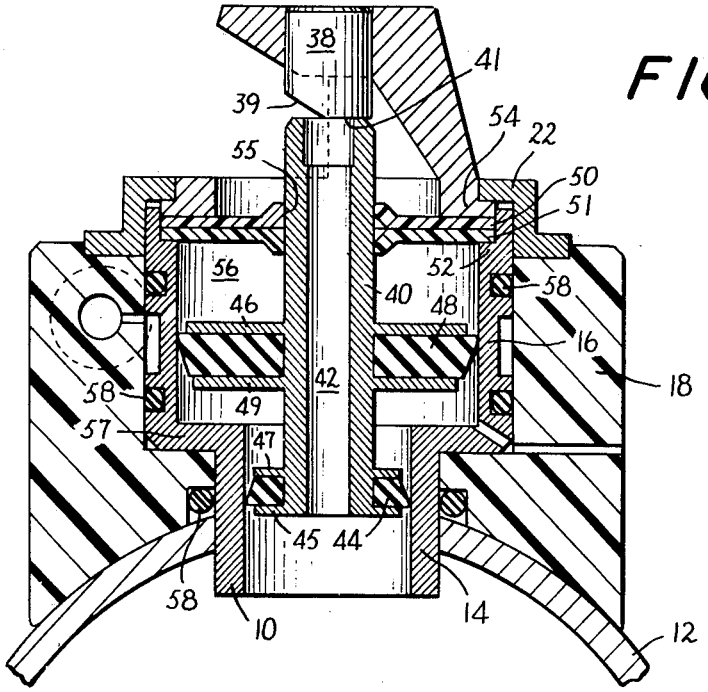
FIG. 3 is a partially sectional view taken along the line 3—3 in the direction of the arrows in FIG. 1 and illustrating the nozzle in the spray position of operation.
Figure 1:
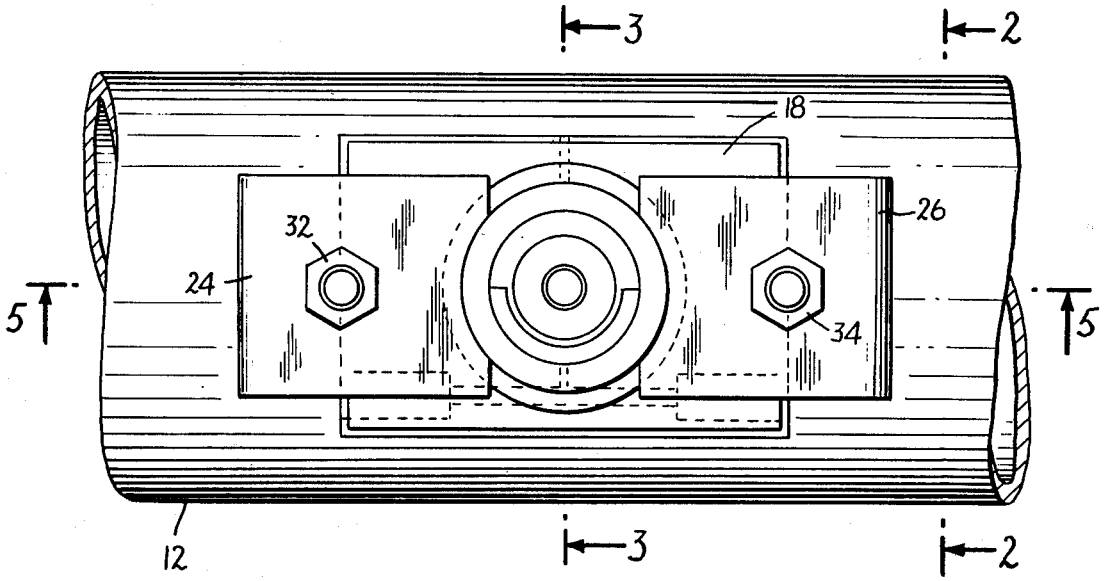
FIG. 1 is a view from above of a nozzle constructed in accordance with the teachings of this invention mounted upon a spray pipe.
Figure 4:
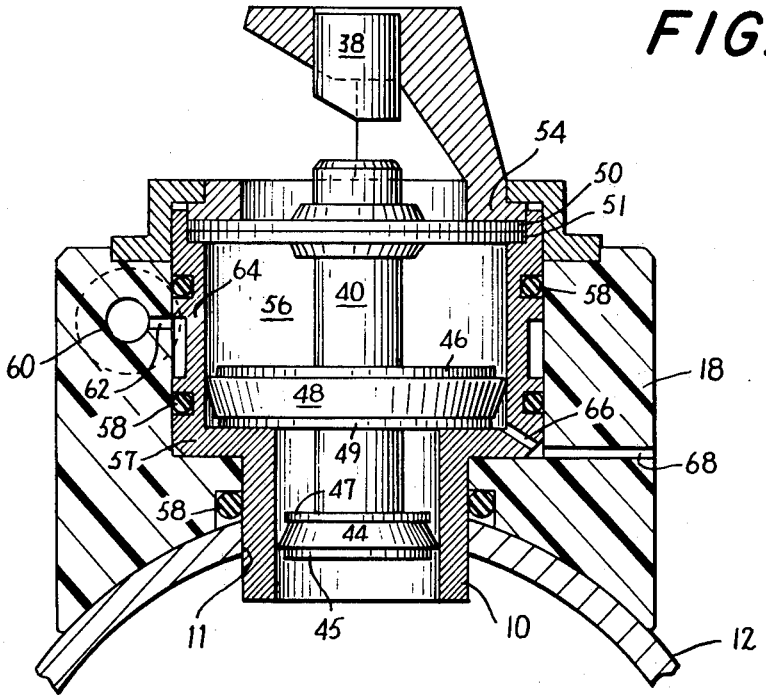
FIG. 4 is a sectional view of the nozzle somewhat similar to FIG. 3 with the nozzle shown in the non-spray or purging position of operation.
Figure 2:
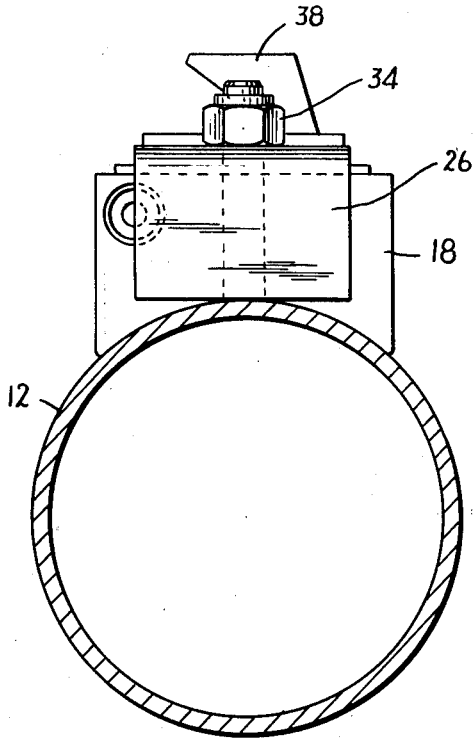
FIG. 2 is a partially sectional view taken along the line 2—2 in the direction of the arrows in FIG. 1.

In the purging position of the piston which is shown for example in FIG. 4, the piston upperend no longer abuts the valving member 38 and liquid from spray pipe 12 can exit through central passage 42 without interference. Accordingly, in the position of the piston shown in FIG. 4 a volume of liquid from the spray pipe will exit the central passage 42 at a lower velocity than the liquid exiting central passage 42 in the spray position of the piston as shown in FIG. 3 and in the FIG. 4 position will not be directed as a spray.

It is seen therefore that in either of the two positions of piston 40 the content of the spray pipe 12 will exit through central passage 42. O-Rings 58 are shown in various positions to prevent leakage as is common in the industry.

A passage 60 is provided in member 18 and communicates with the chamber 56 in the bore of member 10 by means of passage 62 in member 18 and passage 64 in member 10. 60 is a passage for air and enables an operator through a suitable control means to pressurize chamber 56 as desired.

In the design disclosed herein, the piston and seals are provided to be held normally in the upward position which is a spray position shown in FIG. 3 by the water or liquid pressure within spray pipe 12. Hence the normal position when there is water pressure in spray pipe 12 for the piston and the valve is the spray position. In order to move the piston to the purging position, it is necessary that chamber 56 be pressurized by air pressure through conduits 60, 62 and 64. Such action can instantaneously overcome the force developed by the water pressure and rapidly move the piston from the spray position to the purging position and into the position shown in FIG. 4 where flange 49 abuts shoulder 57 of casing 10 which serves as a stop member. The significance of this device is that with this design the transition from one position to another and especially from the spray to the purging position can be accomplished without changing the spray pipe water pressure and substantially instantaneously. Passage 66 in member 10 cooperates with passage 68 in member 18 to vent the bore of member 10 beneath seal 48 to atmosphere so that there is no locking or interference due to air pressure hindering movement of the piston into the flooding position from the spray position.

I claim:

1. In combination with a spray pipe, a spray nozzle, said spray nozzle comprising a generally tubular body in alignment with the spray hole through the wall of said pipe, a bore of said tubular body, a piston slidably fitted in said tubular body within said bore, a central passage formed in said piston and communicating the interior of said spray pipe to the outside thereof, a first seal means mounted on said piston and cooperating with said tubular body and confining the contents of said spray pipe to said central passage, a valving member of said tubular body and disposed on the centerline of said central passage, a spray position of said piston with the outerend thereof abutting said valving member, said piston maintained in said spray position by the force of the content of said spray pipe pressing thereagainst, a blocking surface of said valving member overlying a first portion of said central passage and blocking a portion thereof in said spray position, a spray surface of said valving member spaced from and overlying a second portion of said central passage in said spray position whereby liquid exiting said central passage in said spray position will impinge thereon to be formed into and directed as a spray, a purging position of said piston with the outer end thereof spaced from said valving member, a radial flange of said piston within said bore, second seal means mounted on said flange and cooperating with said tubular body, third seal means mounted on said tubular body and cooperating with said pistons, a pressure chamber within said bore provided by said second and third seal means, air pressure supply means, control means for introducing air pressure from said air pressure supply means into said pressure chamber to overcome the force of the content of said spray pipe and to move said piston into said purging position, stop means formed on said body and against which said flange abuts in said purging position, and air evacuation means to evacuate air from said bore upon movement of said piston to prevent locking thereof.

2. A spray nozzle in accordance with claim 1 in which said control means includes a passage through the wall of said tubular member between said second and third seal means.

3. A spray member in accordance with claim 1 in which said means to evacuate air from said bore includes a passage through the wall of said tubular member between said first and second seal means.

4. A spray nozzle in accordance with claim 1 in which the valving member has a generally cylindrical body whose centerline is an extension of the centerline of said central passage, said blocking surface lies in a plane perpendicular to the centerline of said central passage and overlies more than one-half of said central passage and said spray surface is formed to provide spray configuration and overlies the remainder of said central passage.

5. A spray nozzle in accordance with claim 4 in which said first and second seal means include lip seals.

* * * * *